US007859235B2

(12) United States Patent
Yamashita

(10) Patent No.: US 7,859,235 B2
(45) Date of Patent: Dec. 28, 2010

(54) CONSTANT VOLTAGE POWER SUPPLY CIRCUIT

(75) Inventor: Takahiro Yamashita, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 267 days.

(21) Appl. No.: 12/255,174

(22) Filed: Oct. 21, 2008

(65) Prior Publication Data

US 2009/0128108 A1 May 21, 2009

(30) Foreign Application Priority Data

Oct. 22, 2007 (JP) ..... 2007-274002

(51) Int. Cl.
*G05F 1/575* (2006.01)
*G05F 1/595* (2006.01)

(52) U.S. Cl. ..... 323/274; 323/226; 323/269

(58) Field of Classification Search ..... 323/226, 323/269, 270, 273, 274, 275, 276, 279
See application file for complete search history.

(56) References Cited

U.S. PATENT DOCUMENTS 5,280,233 A * 1/1994 Poletto et al. ..... 323/269
5,608,312 A * 3/1997 Wallace ..... 323/224
6,188,212 B1 2/2001 Larson et al.
6,377,033 B2 * 4/2002 Hsu ..... 323/274
6,441,594 B1 * 8/2002 Connell et al. ..... 323/274
6,452,766 B1 9/2002 Carper
7,057,310 B2 6/2006 Liu et al.

FOREIGN PATENT DOCUMENTS

JP 2007-219856 8/2007

* cited by examiner

*Primary Examiner*—Gary L Laxton
(74) *Attorney, Agent, or Firm*—Oblon, Spivak, McClelland, Maier & Neustadt, L.L.P.

(57) ABSTRACT

A first output transistor forms a first current path between an input and an output terminal and has a first control terminal applied with a first control signal. A second output transistor forms a second current path between the output and a ground terminal and has a second control terminal applied with a second control signal. A first comparator outputs the first control signal to decrease an ON-resistance of the first transistor when an output voltage from the output terminal is a predetermined value or less. A second comparator outputs the second control signal to render the second transistor conductive to decrease the output voltage when the output voltage is a predetermined value or more. An acceleration circuit accelerates charging of the first control terminal of the first transistor to a predetermined potential. The inhibition circuit inhibits the acceleration circuit operation according to a change of the second control signal.

18 Claims, 7 Drawing Sheets

CONSTANT VOLTAGE POWER SUPPLY CIRCUIT

CROSS REFERENCE TO RELATED APPLICATIONS

This application is based on and claims the benefit of priority from prior Japanese Patent Application No. 2007-274002, filed on Oct. 22, 2007, the entire contents of which are incorporated herein by reference.

BACKGROUND OF THE INVENTION

1. Field of the Invention

The present invention relates to a constant voltage power supply circuit adapted to output a constant voltage.

2. Description of the Related Art

One known constant voltage power supply circuit includes a series linear regulator including a CMOS circuit (see, for example, JPH 2007-219856). The series linear regulator contains a reference voltage generation circuit that generates a reference voltage, a comparator that compares the reference voltage and the output voltage, and a pMOS transistor driven by the comparator.

The pMOS transistor is connected between the input terminal and the output terminal. The input terminal receives an input voltage Vin (i.e., the power supply voltage VDD). The output terminal provides an output voltage VOUT. The voltage VOUT is obtained by decreasing and stabilizing the input voltage Vin.

If the output voltage VOUT decreases due to an increased output load, the input voltage at the non-inverting input terminal of the comparator decreases, thus decreasing the output voltage of the comparator. The gate voltage of the pMOS transistor thus decreases and the ON-resistance of the pMOS transistor decreases. This increases the current supplied to the output terminal, thus increasing the output voltage VOUT. In this way, the voltage VOUT is stabilized.

If the output voltage VOUT increases due to a decreased output load, the input voltage at the non-inverting input terminal of the comparator increases, thus increasing the output potential of the comparator. The gate voltage of the pMOS transistor thus increases and the ON-resistance of the p type MOS transistor increases.

This decreases the current supplied to the output terminal, thus decreasing the output voltage VOUT. In this way, the voltage VOUT is stabilized.

A voltage drop in the output transistor must be small (up to 100 mV) even if a large current (a few hundred mA, for example) flows therethrough. Accordingly, an output transistor with a large gate width is often used therefor. This causes a tendency towards larger gate capacitance. The comparator may be designed to be able to drive the gate capacitance. A rapid change of the output current may, however, cause a driving delay that may vary the output voltage. Accordingly, a need exists for a voltage regulator that may reduce the output variation without complicating the circuitry such as the comparator or increasing the circuitry area.

SUMMARY OF THE INVENTION

According to an aspect of the present invention, a constant voltage power supply circuit comprises: a first output transistor connected between an input terminal and an output terminal, the first output transistor forming a first current path between the input and output terminals, the first output transistor having a first control terminal applied with a first control signal to control a current flow through the first current path; a second output transistor connected between the output terminal and the ground terminal, the second output transistor forming a second current path between the output and ground terminals, the second output transistor having a second control terminal applied with a second control signal to control a current flow through the second current path; a first comparator outputting the first control signal to decrease an ON-resistance of the first output transistor when an output voltage from the output terminal reaches a predetermined value or less; a second comparator outputting the second control signal to render the second output transistor conductive to decrease the output voltage when the output voltage reaches a predetermined value or more; an acceleration circuit accelerating charging of the first control terminal of the first output transistor to a predetermined potential; and an inhibition circuit inhibiting the acceleration circuit operation according to a change of the second control signal.

DETAILED DESCRIPTION OF THE EMBODIMENTS

With reference to the accompanying drawings, preferred embodiments of the present invention will be described in more detail.

First Embodiment

Figure 1:
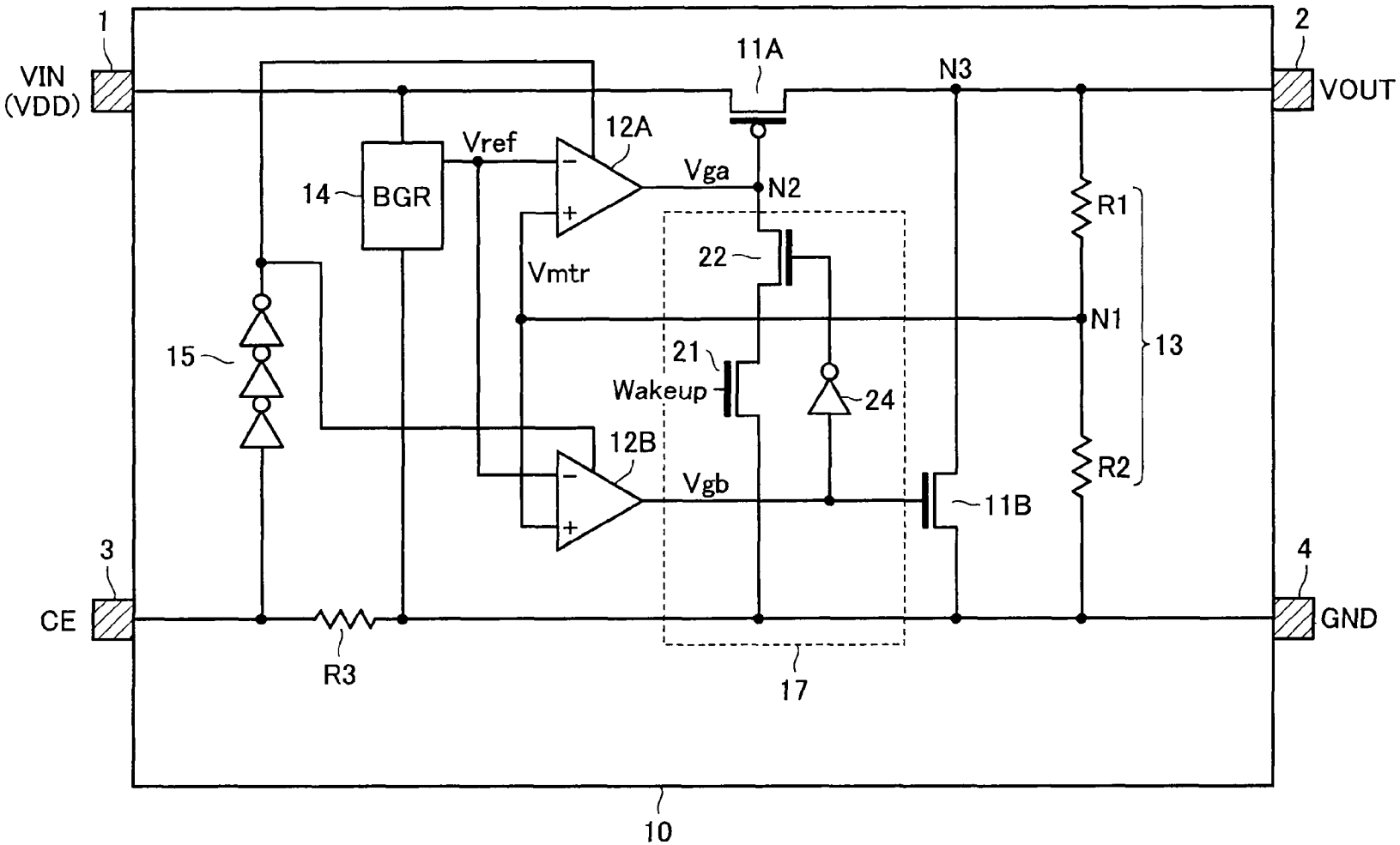
FIG. 1 is a circuit diagram showing circuitry of a series regulator 10 as a constant voltage power supply circuit.
Figure 2:
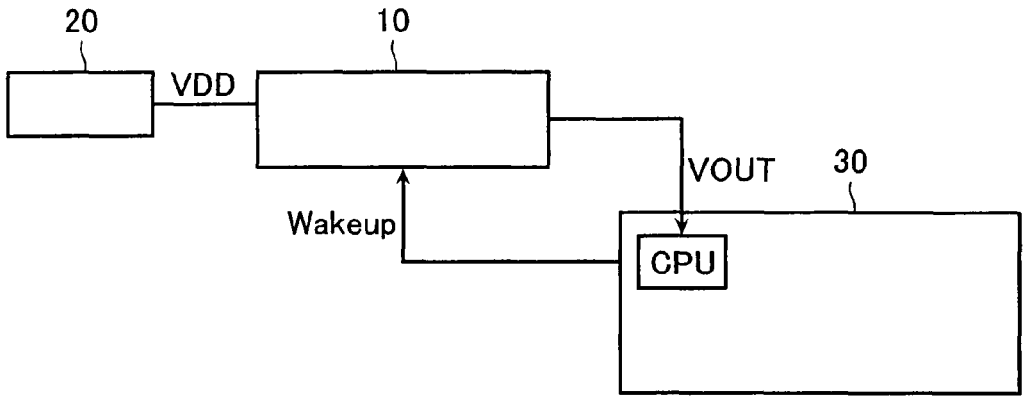
FIG. 2 shows an example of how the series regulator 10 may be utilized.

With reference to the drawings, a constant voltage power supply circuit according to a first embodiment of the present invention will be described below. FIG. 1 is a circuit diagram showing circuitry of a series regulator 10 as a constant voltage power supply circuit. FIG. 2 shows an example of how the series regulator 10 may be utilized.

The series regulator 10 receives an input voltage VIN (for example, a power supply voltage VDD) at an input terminal 1. The regulator 10 has a function of decreasing and stabilizing the input voltage to provide a constant output voltage VOUT at an output terminal 2. The series regulator 10 includes a chip enable terminal 3 and a ground terminal 4. The chip enable terminal 3 receives a chip enable signal that instructs the start of the circuit operation. The ground terminal 4 is given a ground potential VSS.

With reference to FIG. 2, the series regulator 10 may be used, for example, to receive the power supply voltage VDD from a power supply circuit 20 and provide an output voltage VOUT to, for example, a semiconductor integrated circuit 30 that includes a CPU 31. The load current in the semiconductor integrated circuit 30 varies depending on whether, for example, the semiconductor integrated circuit 30 is in operation or on standby or the like. For the variable load current, the series regulator 10 is adapted to minimize the variation of the output voltage VOUT. In order to stabilize the output voltage VOUT, the series regulator 10 in this embodiment receives an input signal Wakeup from the CPU 31 when the CPU 31 senses the variation of the load current.

Returning to FIG. 1, the configuration of the series regulator 10 will be described in more detail. The series regulator 10 includes a p type MOS transistor 11A, an n type MOS transistor 11B, operational amplifiers 12A and 12B, a divider resistor 13, a reference voltage generation circuit 14, an inverter chain circuit 15, and a discharge circuit 17. The series regulator 10 may be configured as a discrete circuit working alone or a circuit included in a semiconductor integrated circuit.

The p type MOS transistor 11A is an output transistor connected between the input terminal 1 and the output terminal 2. The gate of the transistor 11A is connected to the output terminal of the operational amplifier 12A. As described below, the gate voltage (the voltage applied to the gate) of the p type MOS transistor 11A is controlled according to the variation of the output voltage VOUT at the output terminal 2. The output voltage VOUT may thus be controlled to be constant.

The n type MOS transistor 11B is an output transistor connected between the output terminal 2 and the ground terminal 4. The gate of the transistor 11B is connected to the output terminal of the operational amplifier 12B. As described below, the gate voltage (the voltage applied to the gate) of the n type MOS transistor 11B is controlled according to the variation of the output voltage VOUT. The output voltage VOUT may thus be controlled to be constant.

More specifically, the operational amplifier 12A is a comparator. The amplifier 12A compares a voltage Vmtr and a reference voltage Vref, amplifies the difference between them, and then outputs a gate signal Vga. The voltage Vmtr is provided by dividing the output voltage VOUT with the divider resistor 13 at a predetermined resistance divider ratio. The reference voltage Vref is generated by the reference voltage generation circuit 14. When the output voltage VOUT decreases to a predetermined value or less, the operational amplifier 12A changes the gate signal Vga to reduce the ON-resistance of the p type MOS transistor 11A. The drain voltage (i.e., the output voltage VOUT) of the p type MOS transistor 11A is thus controlled to be constant.

Like the operational amplifier 12A, the operational amplifier 12B compares the voltage Vmtr and the reference voltage Vref, amplifies the difference between them, and thus outputs a gate signal Vgb. The reference voltage Vref is generated by the reference voltage generation circuit 14. When the output voltage VOUT increases to a predetermined value or more, the operational amplifier 12B changes the gate signal Vgb to render the n type MOS transistor 11B conductive and thus reduce the output voltage VOUT. Like the operational amplifier 12A, the operational amplifier 12B has a function of controlling the output voltage VOUT to be constant.

The reference voltage generation circuit 14 includes a band gap reference circuit. The reference circuit works by being supplied with the power supply voltage VDD (as the input voltage) and the ground potential VSS. The reference voltage Vref generated by the band gap reference circuit changes little, depends weakly on temperature, and thus is stable, and has a value of, for example, 1.2 V.

The inverter chain circuit 15 receives the chip enable signal CE from the chip enable terminal 3 and outputs a signal to activate the operational amplifiers 12A and 12B.

The discharge circuit 17 receives the input signal Wakeup when the CPU 31 senses the change of the output current in the semiconductor integrated circuit 30. The circuit 17 then accelerates the discharge of the gate terminal voltage of the p type MOS transistor 11A to the ground potential GND. When the output voltage VOUT decreases, the operational amplifier 12A reduces the gate terminal voltage of the p type MOS transistor 11A to keep the output voltage VOUT constant. If, however, the p type MOS transistor 11A has a large gate capacitance, the operational amplifier 12A alone is insufficient to discharge the gate capacitance. The discharge circuit 17 may then aid the rapid discharge of the charge accumulated in the parasitic capacitance of the gate capacitance of the p type MOS transistor 11A. The output voltage VOUT may thus be stabilized.

More specifically, the discharge circuit 17 includes n type MOS transistors 21 and 22 and an inverter 24. The n type MOS transistors 21 and 22 are connected in series between the gate terminal of the p type MOS transistor 11A and the ground potential GND. The n type MOS transistor 21 receives the input signal Wakeup at its gate. The input signal Wakeup is usually "L." The Wakeup is, for example, a one-pulse signal that rises to "H" for a short period of about 30 nS.

The n type MOS transistor 22 receives the gate signal Vgb at its gate via the inverter 24. The n type MOS transistor 22 thus has a function of inhibiting the discharge by the discharge circuit 17 regardless of the state of the input signal Wakeup. In other words, the n type MOS transistor 21 functions as an acceleration circuit that accelerates the charging of the gate of the p type MOS transistor 11A to a predetermined potential. Additionally, the n type MOS transistor 22 functions as an inhibition circuit that inhibits the operation of the n type MOS transistor 21 as the acceleration circuit.

The operation of the discharge circuit 17 of the series regulator 10 will now be described.

For example, when the CPU 31 senses the load current increase, the input signal Wakeup rises from "L" to "H" for a short period of about 30 nS. The n type MOS transistor 21 then turns on, thus discharging the charge accumulated in the parasitic capacitance of the gate of the p type MOS transistor 11A. When the input signal Wakeup falls from "H" to "L," the n type MOS transistor 21 turns off, thus stopping the discharge of the gate of the p type MOS transistor 11A. Then, when the operational amplifier 12A senses the decrease of the output voltage VOUT, and the amplifier 12A turns on the p type MOS transistor 11A, thus reducing the ON-resistance. The output voltage VOUT is thus increased. At this time, the gate of the p type MOS transistor 11A has already been discharged and the transistor 11A is ready to pass a large current, the transistor 11A may thus be immediately changed to the steady state.

Figure 3:
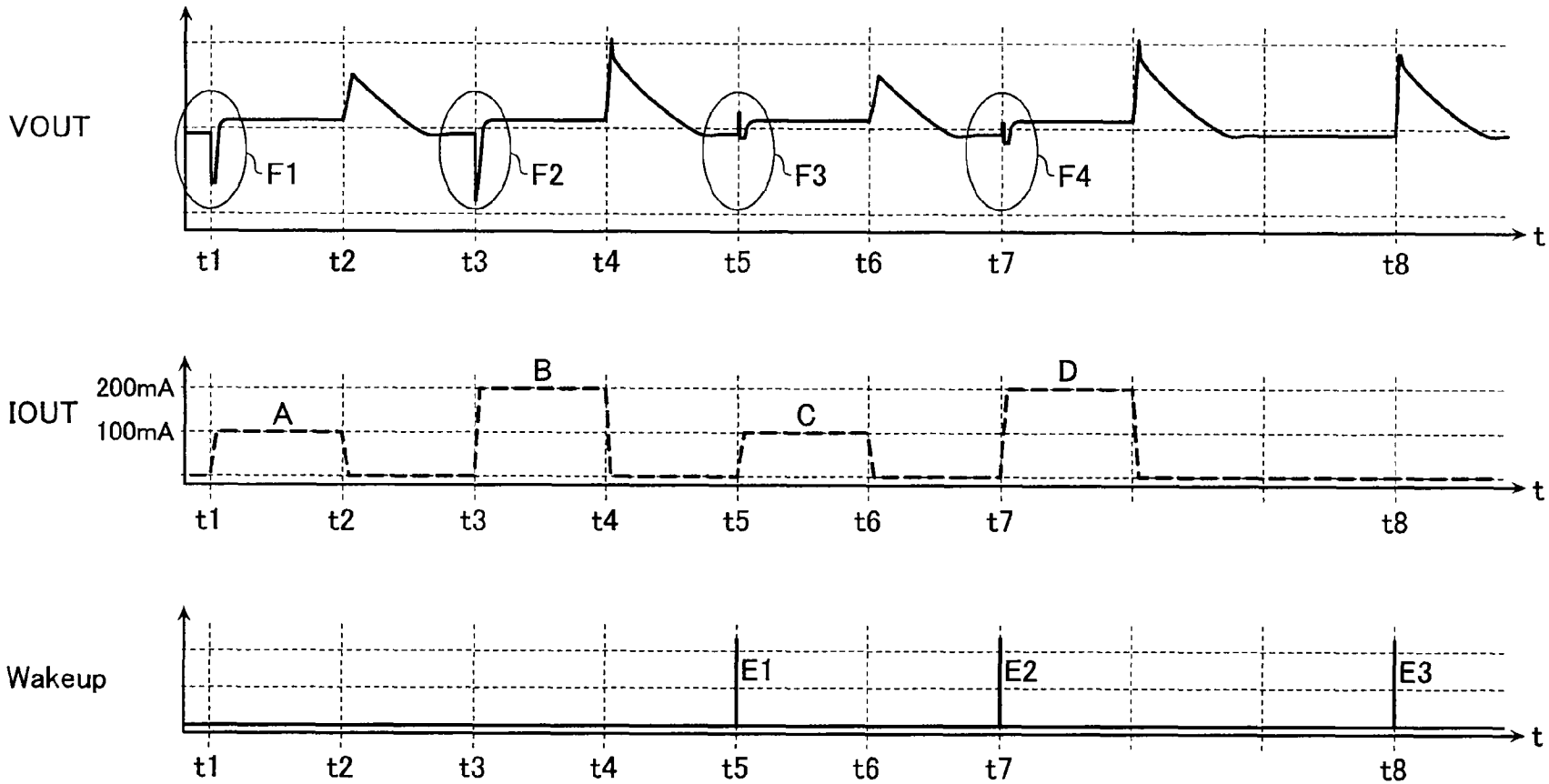
FIG. 3 shows simulated waveforms (an output current IOUT, an output voltage VOUT, and an input signal Wakeup) both in the operation of the series regulator 10 in a first embodiment and in the operation of a conventional series regulator (the regulator in FIG. 1 minus the discharge circuit 17)

FIG. 3 shows simulated waveforms (an output current IOUT, an output voltage VOUT, and an input signal Wakeup) both in the operation of the series regulator 10 in the first embodiment and in the operation of a conventional series regulator (the regulator in FIG. 1 minus the discharge circuit 17). In FIG. 3, times t1 to t5 show waveforms of the operation of the conventional series regulator, and time t6 and later show waveforms of the operation of the series regulator 10 in this embodiment.

In the conventional series regulator, when the output current IOUT rises from 0 to 100 mA at time t1 (the waveform A), the output voltage VOUT experiences a temporal and large drop as shown by the symbol F1. Similarly, when the output current IOUT rises from 0 to 200 mA at time t3 (the waveform B), the output voltage VOUT experiences another temporal and larger drop as shown by the symbol F2. After the drops such as the waveforms F1 and F2, the p type MOS transistor 11A increases the output voltage VOUT, and then the n type MOS transistor 11B converges the VOUT to the original value.

In contrast, in the series regulator 10 in this embodiment, the CPU 31 senses, for example, the increase of the output current IOUT from 0 to 100 mA at time t5 (the waveform C), and outputs the input signal Wakeup (the waveform E1). The input signal Wakeup allows the gate of the p type MOS transistor 11A to be discharged. The drop of the output voltage VOUT is thus smaller than the F1, as shown by the symbol F3. Even when the output current IOUT has a large change from 0 to 200 mA (the waveforms E2 and D), the drop width is smaller than the F1 and F2, although it is larger than the F3.

Even when the input signal Wakeup rises (the waveform E3) for some reason regardless of no increase of the output current IOUT, the output voltage VOUT has no large change. This may be because the input signal Wakeup rises for a short amount of time of about 30 nS, and then only the charge accumulated in the parasitic capacitance of the gate of the p type MOS transistor 11A is discharged, and so the transistor 11A substantially does not turn on.

Figure 4:
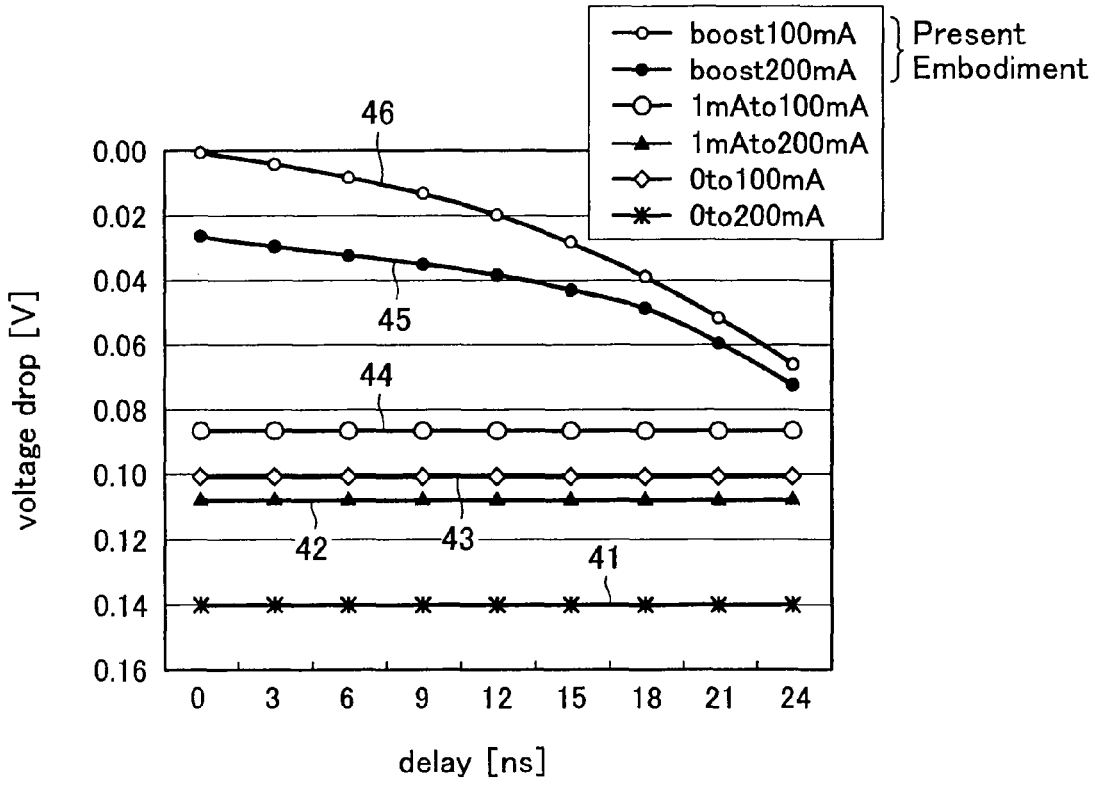
FIG. 4 shows an effect of the first embodiment.

FIG. 4 shows an effect of this embodiment. FIG. 4 shows a profile of drop width of output voltage VOUT versus output delay time of input signal Wakeup for a change of output current IOUT.

In FIG. 4, the curves 41 to 44 correspond to conventional series regulators without the discharge circuit 17 (also without the input signal Wakeup output). The curve 41 corresponds to the output current IOUT that increases from 0 to 200 mA. The curve 42 corresponds to the output current IOUT that increases from 0 to 100 mA. The curve 43 corresponds to the output current IOUT that increases from 1 mA (intentionally flowed in advance) to 200 mA. The curve 44 corresponds to the output current IOUT that increases from 1 mA to 100 mA. In each case, the output voltage VOUT has a drop width of 80 mV or more. Each width is larger than 60 mV, which is generally acceptable in the latest semiconductor integrated circuits.

In contrast, in this embodiment, the discharge circuit 17 may be provided to output the input signal Wakeup when the increase of the output current is sensed. The drop width of the output voltage VOUT may thus be reduced as shown by the curves 45 and 46. As the delay time of the input signal Wakeup is decreased, the drop width is reduced. FIG. 4 shows that the delay time of 12 nS or less may provide the drop width of the output voltage VOUT of 60 mV or less.

Second Embodiment

Figure 5:
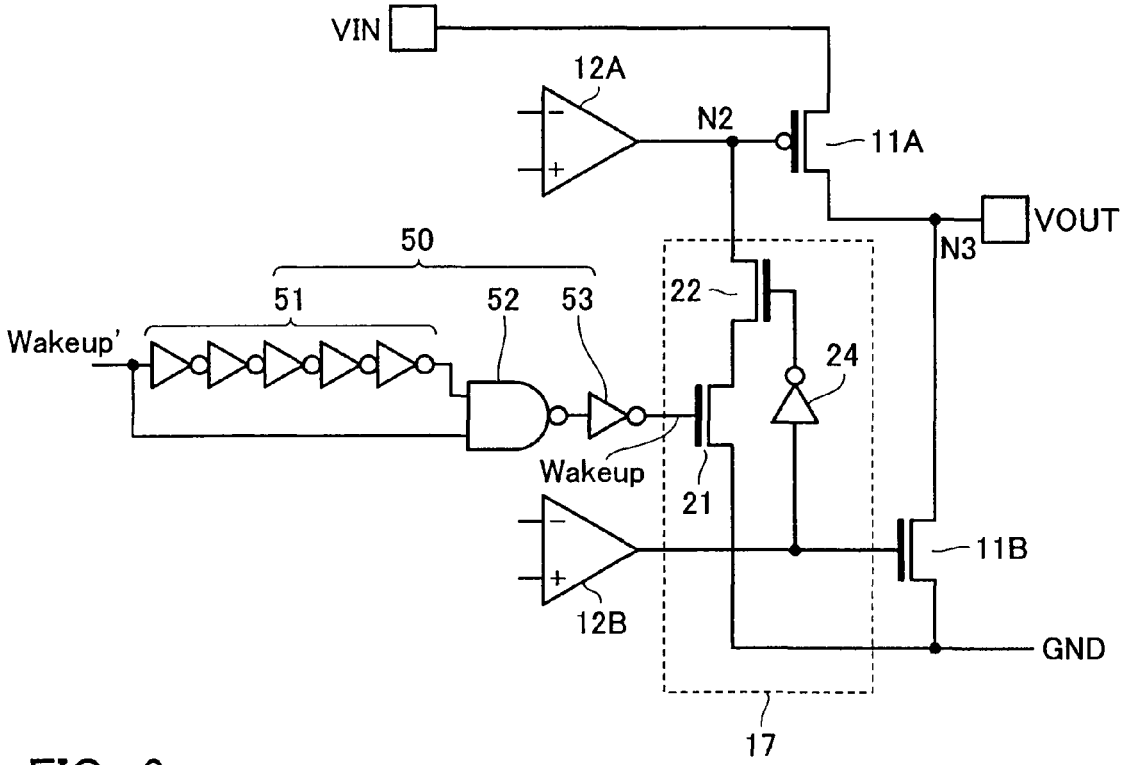
FIG. 5 is a circuit diagram showing the configuration of the main portion of a second embodiment of the present invention.

With reference to FIG. 5, a second embodiment of the present invention will now be described. FIG. 5 shows only the configuration of the main portion near the discharge circuit 17 in the series regulator 10 according to the second embodiment of the present invention. The other portions are similar to those in the first embodiment (FIG. 1), and so their detailed description is omitted here.

In this embodiment, the input signal Wakeup' from the CPU 31 is not a pulse signal having a short pulse width of about 30 nS. Alternatively, the Wakeup' is a signal that rises from "L" to "H" when the decrease of the output current IOUT is sensed and then holds "H."

It may be overload for the CPU 31 in the semiconductor integrated circuit 30 (the output load) to control the pulse width of the input signal Wakeup'. A pulse generation circuit 50 as shown in FIG. 5 may then be provided to reduce the load of the CPU 31 and more accurately control the pulse width.

With reference to FIG. 5, the pulse generation circuit 50 includes, by way of example, an inverter chain circuit 51, a NAND gate 52, and an inverter 53. The inverter chain circuit 51 includes a plurality of inverters connected in cascade to delay the input signal Wakeup' for a predetermined time.

The NAND gate 52 makes a logical AND of the input signal Wakeup' and the output signal of the inverter chain circuit 51 and outputs a signal of the logical negation value thereof. The inverter 53 receives the output signal of the NAND gate 52 and supplies the input signal Wakeup to the gate of the n type MOS transistor 21. The Wakeup is the inversion signal of the output signal of the NAND gate 52. The input signal Wakeup has a pulse width that depends on the number of inverters connected in cascade in the inverter chain circuit 51.

Third Embodiment

Figure 6:
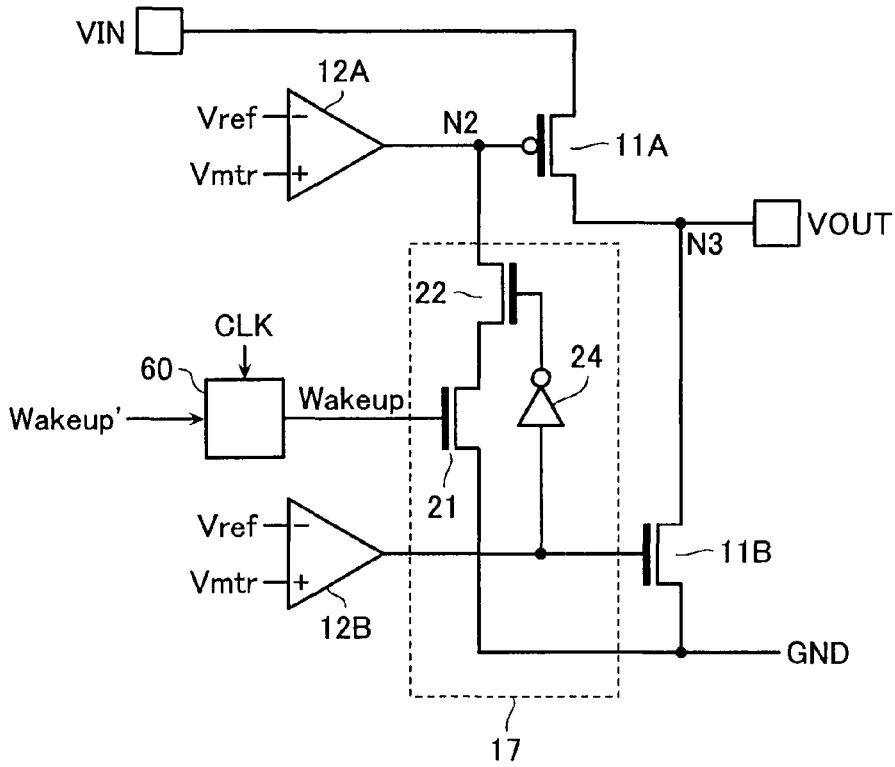
FIG. 6 is a circuit diagram of the configuration of the main portion of a third embodiment of the present invention.

With reference to FIG. 6, a third embodiment of the present invention will now be described. FIG. 6 shows only the configuration of the main portion near the discharge circuit 17 in the series regulator 10 according to the third embodiment of the present invention. The other portions are similar to those in the first embodiment (FIG. 1), and so their detailed description is omitted here.

In this embodiment, like the second embodiment, the input signal Wakeup' is not a pulse signal having a short pulse width of about 30 nS. Alternatively, the Wakeup' is a signal that rises from "L" to "H" when the decrease of the output current IOUT is sensed and then holds "H." A counter circuit 60 is provided to convert the input signal Wakeup' to the input signal Wakeup having a pulse width of about 30 nS. The counter circuit 60 receives the input signal Wakeup' and a clock signal CLK having a cycle of, for example, about 5 nS. After the input signal Wakeup' rises from "L" to "H," the counter circuit 60 raises the output signal (the input signal Wakeup) from "L" to "H." After the circuit 60 counts a predetermined number of clock signals CLK, the circuit 60 returns the input signal Wakeup from "H" to "L." The pulse width of the input signal Wakeup may thus be controlled to a desired width.

Fourth Embodiment

Figure 7:
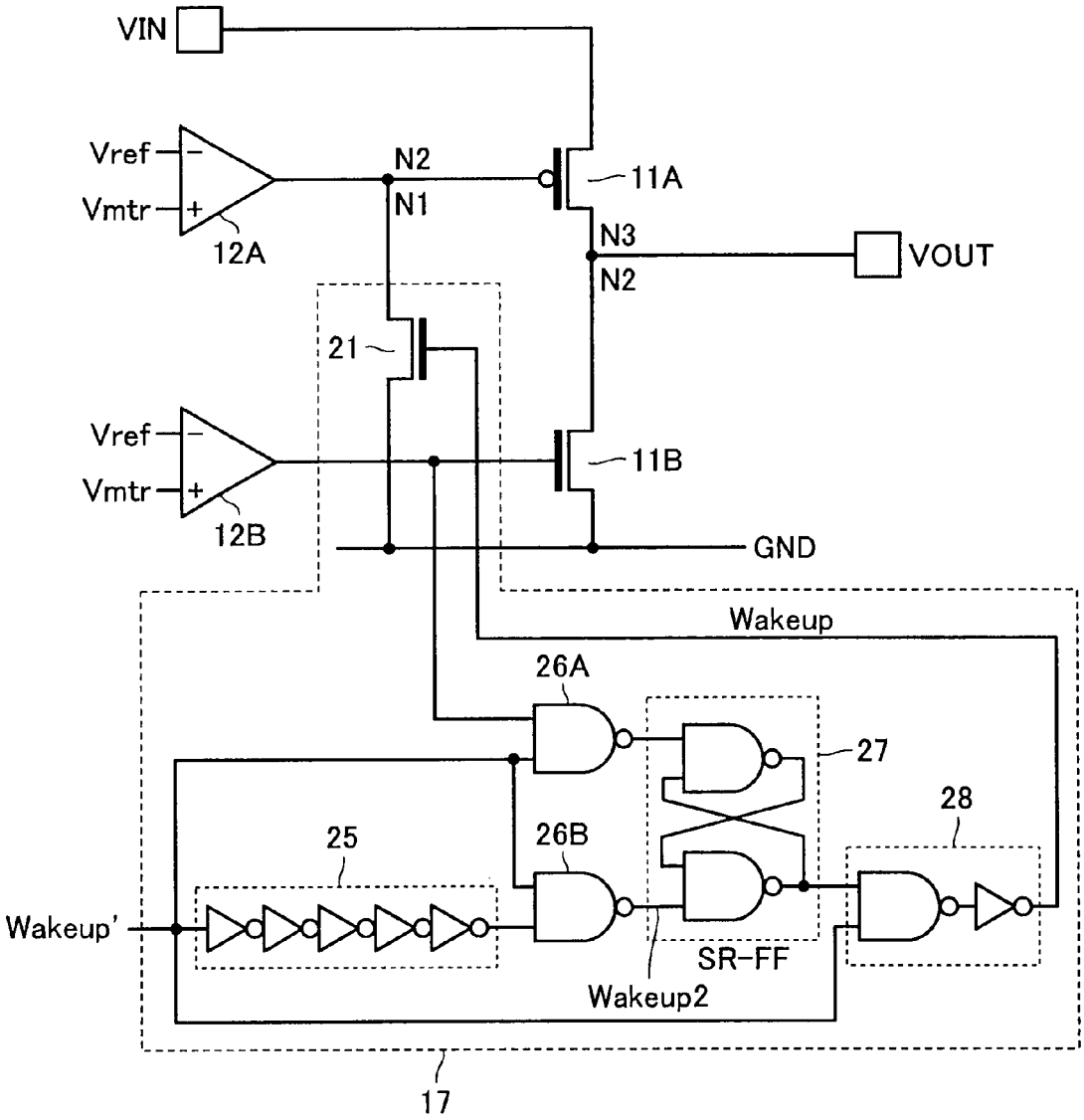
FIG. 7 is a circuit diagram of the configuration of the main portion of a fourth embodiment of the present invention.

With reference to FIG. 7, a fourth embodiment of the present invention will now be described. FIG. 7 shows only the configuration of the main portion near the discharge circuit 17 in the series regulator 10 according to the fourth embodiment of the present invention. The other portions are similar to those in the first embodiment (FIG. 1), and so their detailed description is omitted here.

In this embodiment, like the second embodiment, the input signal Wakeup' is not a pulse signal having a short pulse width of about 30 nS. Alternatively, the Wakeup' is a signal that rises from "L" to "H" when the decrease of the output current IOUT is sensed and then holds "H." With reference to FIG. 7, this embodiment omits the n type MOS transistor 22 and the inverter circuit 24. Alternatively, an inverter chain circuit 25, a NAND gate 26A, a NAND gate 26B, an SR flip-flop circuit 27, and an AND gate 28 are provided. Each of the inverter chain circuit 25 and the NAND gate 26B receives the input signal Wakeup'. The NAND gate 26B then outputs a pulse signal Wakeup2 that rises for a short period of time "H."

When the negative logic pulse signal Wakeup2 falls, the output signal of the SR flip-flop circuit 27 is set to "H." When both of the output signal of the circuit 27 and the input signal Wakeup' are "H," the AND gate 28 outputs the input signal Wakeup at "H."

The NAND gate 26A receives the input signal Wakeup' and the output signal of the operational amplifier 12B. The gate 26A provides the output signal to a reset terminal of the SR flip-flop circuit.

In this embodiment, the NAND gate 26A, the SR flip-flop circuit 27, and the AND gate 28 comprise the inhibition circuit. The inhibition circuit is to inhibit the operation of the n type MOS transistor 21 included in the acceleration circuit. Specifically, when the input signal Wakeup' rises from "L" to "H," the input signal Wakeup2 rises for a short period to set the SR flip-flop circuit 27. The AND gate 28 makes a logical AND of the input signal Wakeup' at "H" and the output signal of the SR flip-flop circuit 27. The gate 28 then outputs the logical AND, i.e., the input signal Wakeup="H." The n type MOS transistor 21 is thus turned on, thereby accelerating the discharge of the gate of the p type MOS transistor 11A.

If, for the input signal Wakeup'="H," the operational amplifier 12B detects that the output current IOUT increases and the output voltage VOUT exceeds a predetermined value for some reason and the gate signal Vgb rises to "H," the output signal of the NAND gate 26A falls to "L." The SR flip-flop circuit 27 is thus reset, providing the output signal of "L." The input signal Wakeup thus falls to "L," which turns off the n type MOS transistor 21. The operation of the n type MOS transistor 21 included in the acceleration circuit is thus inhibited.

In this embodiment, the NAND gate 26B outputs the input signal Wakeup2 as a pulse signal only when the input signal Wakeup' rises from "L" to "H," and the gate 26B does not output the pulse signal when the input signal Wakeup' falls from "H" to "L." This is to prevent the input of the SR flip-flop circuit 27 from being in the inhibit state (LL) because it is unknown when the NAND gate 26A outputs a signal to reset the SR flip-flop circuit 27.

The AND gate 28 is provided for the following reason. Whether the SR flip-flop circuit 27 is set to "H" or "L" on power-up, the n type MOS transistor 21 will be turned on automatically if the output signal is "H." The AND gate 28 is to prevent this phenomenon. The AND gate 28 may eliminate the reset of the SR flip-flop circuit 27 on power-up, thus facilitating the initial setting.

In this embodiment, the SR flip-flop circuit 27 stores the fact that the input signal Wakeup' rises from "L" to "H," and then the SR flip-flop circuit 27 is reset when the output voltage VOUT that has been temporarily decreased becomes more than the original value and exceeds a predetermined value. The reset of the circuit 27 turns off the n type MOS transistor 21. The output voltage VOUT may thus be stabilized more effectively.

Figure 8:
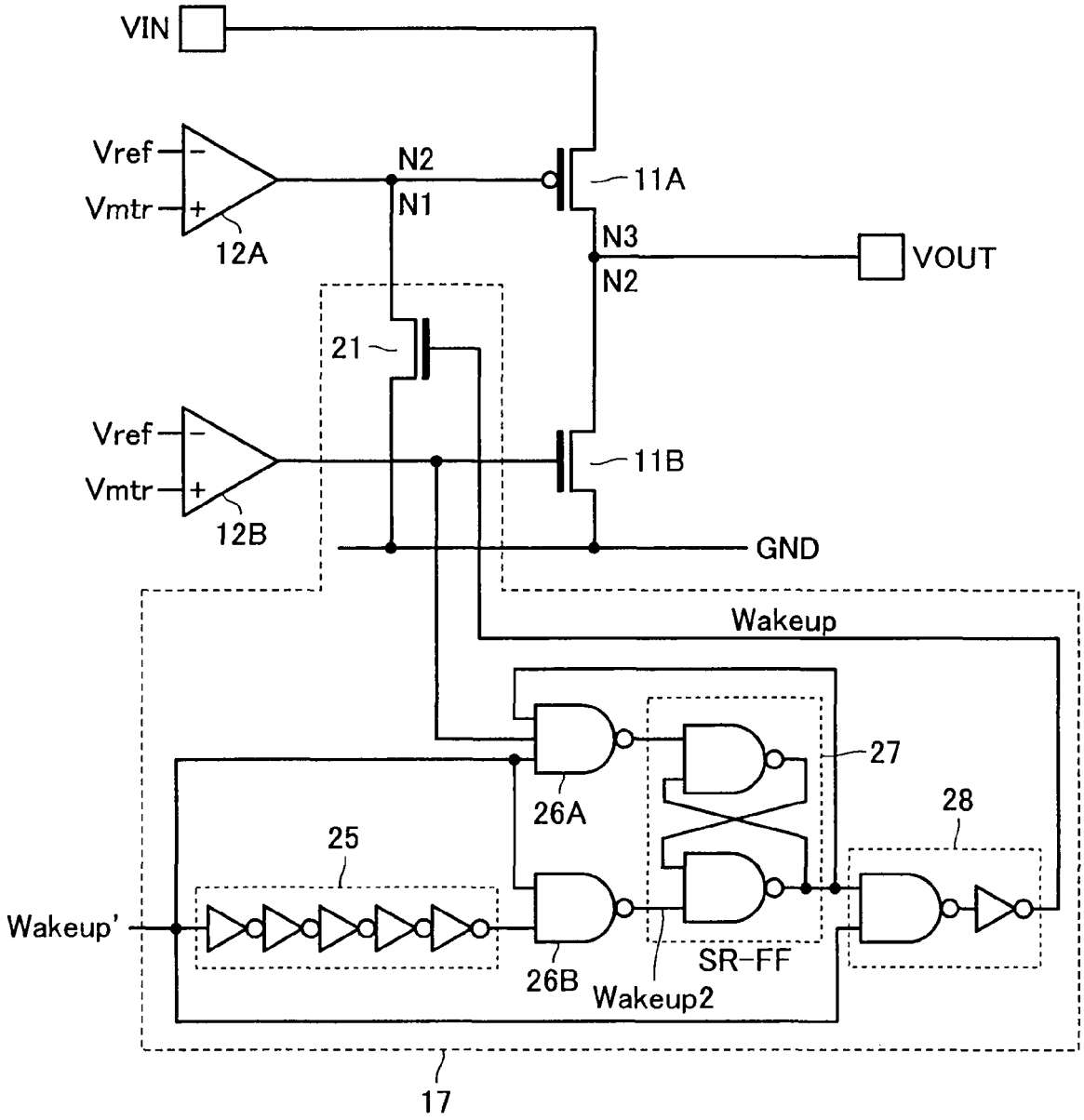
FIG. 8 is a circuit diagram of the configuration of the main portion of a modification of the fourth embodiment of the present invention.

With reference to FIG. 8, in this embodiment, the NAND gate 26A may have a three terminal input, and the output signal of the SR flip-flop circuit 27 may be fed back to one of the input terminals. In the configuration in FIG. 7, a leak current passes through the NAND gate 26A when the input signal Wakeup' is "H." In the configuration in FIG. 8, however, no leak current passes through the gate 26A after the SR flip-flop circuit 27 is reset. More power consumption may thus be reduced than in FIG. 7.

Modifications and Others

Thus, although the invention has been described with respect to particular embodiments thereof, it is not limited to those embodiments. It will be understood that various modifications and additions and the like may be made without departing from the spirit of the present invention. In the above embodiments, for example, the operational amplifiers 12A and 12B receive the same reference voltage Vref generated by the same reference voltage generation circuit 14. Alternatively, the amplifiers may receive different reference voltages generated through the divider resistors or the like from the same reference voltage.

Alternatively, different reference voltage generation circuits may be provided for the operational amplifiers 12A and 12B.

Figure 9:
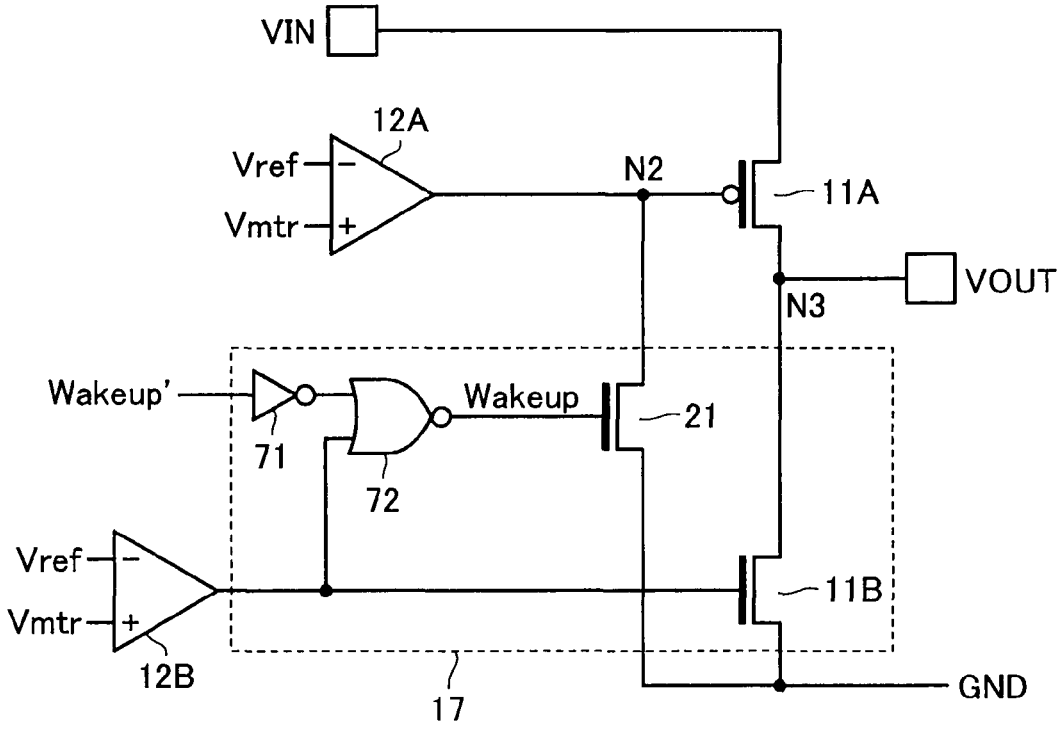
FIG. 9 is a circuit diagram of a modification of an embodiment of the present invention.

In the above embodiments, the inhibition circuit includes the n type MOS transistors 21 and 22 connected in series. The present invention is not limited thereto. The inhibition circuit may also have any other configurations that may prevent the operation of the transistor or the like included in the acceleration circuit. With reference to FIG. 9, for example, the inhibition circuit may include an inverter 71 and a NOR gate 72. In FIG. 9, like elements as those in the above embodiments are designated with like reference numerals, and their detailed description is omitted here.

The inverter 71 receives the input signal Wakeup' and outputs the inversion signal thereof. The signal Wakeup' rises from "L" to "H" when the decrease of the output current IOUT is sensed and then holds "H." The NOR gate 72 receives the output signal of the inverter 71 and the output signal of the operational amplifier 12B. In this configuration, when the operational amplifier 12B senses the increase of the output voltage VOUT and outputs "H," the n type MOS transistor 21 is not turned on even when the signal Wakeup' is "H." Specifically, the inverter 71 and the NOR gate 72 together function as the inhibition circuit that inhibits the operation of the acceleration circuit. The inhibition circuit may have any other configurations that may provide the above functions.

What is claimed is:

1. A constant voltage power supply circuit comprising:

a first output transistor connected between an input terminal and an output terminal, the first output transistor forming a first current path between the input and output terminals, the first output transistor having a first control terminal applied with a first control signal to control a current flow through the first current path;

a second output transistor connected between the output terminal and a ground terminal, the second output transistor forming a second current path between the output and ground terminals, the second output transistor having a second control terminal applied with a second control signal to control a current flow through the second current path;

a first comparator outputting the first control signal to decrease an ON-resistance of the first output transistor when an output voltage from the output terminal reaches a predetermined value or less;

a second comparator outputting the second control signal to render the second output transistor conductive to decrease the output voltage when the output voltage reaches a predetermined value or more;

an acceleration circuit accelerating charging of the first control terminal of the first output transistor to a predetermined potential; and an inhibition circuit inhibiting the acceleration circuit operation according to a change of the second control signal.

2. The constant voltage power supply circuit according to claim 1, wherein the acceleration circuit and the inhabitation circuit comprise a first transistor and a second transistor, the first and second transistors being connected in series between the gate of the first output transistor and an terminal supplying the predetermined potential.

3. The constant voltage power supply circuit according to claim 1, further comprising a divider resistor, the divider resistor dividing the output voltage at a predetermined resistance divider ratio to generate a divided voltage, and wherein each of the first and second comparators are adapted to compare the divided voltage with a reference voltage.

4. The constant voltage power supply circuit according to claim 1, wherein the first output transistor is a p type MOS transistor, and the acceleration circuit is adapted to accelerate discharge of the first control terminal to the ground potential.

5. The constant voltage power supply circuit according to claim 1, wherein the acceleration circuit comprises an n type MOS transistor, and the gate of the n type MOS transistor is supplied with a pulse signal that rises for a predetermined period when variation of a load current in an output load connected to the output terminal is sensed.

6. The constant voltage power supply circuit according to claim 1, further comprising a pulse generation circuit, the pulse generation circuit comprising:

an inverter chain circuit that receives a first input signal output from an output load connected to the output terminal and generates a second input signal by delaying the first input signal; and a logic circuit that outputs a logical AND of the first and second input signals as a pulse signal, and wherein the acceleration circuit is controlled according to the pulse signal.

7. The constant voltage power supply circuit according to claim 6, wherein the acceleration circuit comprises an n type MOS transistor, and the gate of the n type MOS transistor is supplied with a pulse signal that rises for a predetermined period when variation of a load current in the output load connected to the output terminal is sensed.

8. The constant voltage power supply circuit according to claim 6, wherein the first output transistor is a p type MOS transistor, and the acceleration circuit is adapted to accelerate discharge of the first control terminal to the ground potential.

9. The constant voltage power supply circuit according to claim 8, wherein the acceleration circuit comprises an n type MOS transistor, and the gate of the n type MOS transistor is supplied with a pulse signal that rises for a predetermined period when variation of the load current in the output load connected to the output terminal is sensed.

10. The constant voltage power supply circuit according to claim 1, further comprising a counter circuit, the counter circuit raising a pulse signal after a logic change in a first input signal output from an output load is sensed, the output load being connected to the output terminal, and the counter circuit lowering the pulse signal after a predetermined number of clock signals are counted, and wherein the acceleration circuit is controlled according to the pulse signal.

11. The constant voltage power supply circuit according to claim 1, wherein the acceleration circuit starts operation in response to an external instruction signal.

12. The constant voltage power supply circuit according to claim 11, wherein the instruction signal changes its logic when a change of the output current in the output load that is connected to the output terminal is sensed.

13. The constant voltage power supply circuit according to claim 11, further comprising a flip-flop circuit, the flip-flop circuit being set to a first state when the instruction signal rises from first logic to second logic, and the flip-flop circuit being set to a second state when the second control signal changes, and wherein the acceleration circuit is able to operate when the flip-flop circuit is in the first state, and the acceleration circuit is inhibited from operating when the flip-flop circuit is in the second state.

14. The constant voltage power supply circuit according to claim 13, further comprising a logic circuit, the logic circuit outputting a logical AND signal of the output signal of the flip-flop circuit and the instruction signal, and wherein the acceleration circuit is controlled according to the logical AND signal.

15. The constant voltage power supply circuit according to claim 11, further comprising a divider resistor, the divider resistor dividing the output voltage at a predetermined resistance divider ratio to generate a divided voltage, and wherein each of the first and second comparators is adapted to compare the divided voltage with a reference voltage.

16. The constant voltage power supply circuit according to claim 11, wherein the acceleration circuit comprises an n type MOS transistor, and the gate of the n type MOS transistor is supplied with a pulse signal that rises for a predetermined period when variation of a load current in an output load that is connected to the output terminal is sensed.

17. The constant voltage power supply circuit according to claim 11, wherein the first output transistor is a p type MOS transistor, and the acceleration circuit is adapted to accelerate discharge of the first control terminal to the ground potential.

18. The constant voltage power supply circuit according to claim 17, wherein the acceleration circuit comprises an n type MOS transistor, and the gate of the n type MOS transistor is supplied with a pulse signal that rises for a predetermined period when variation of a load current in an output load that is connected to the output terminal is sensed.

* * * * *